US006304228B1

(12) United States Patent
Smith et al.

(10) Patent No.: US 6,304,228 B1
(45) Date of Patent: Oct. 16, 2001

(54) STEPPED WAVEGUIDE SLOT ARRAY WITH PHASE CONTROL AND SATELLITE COMMUNICATION SYSTEM EMPLOYING SAME

(75) Inventors: Terry M. Smith, La Honda; George Hardie, Santa Barbara, both of CA (US); Juan Duarte, McCall, ID (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/684,299

(22) Filed: Oct. 6, 2000

(51) Int. Cl.[7] ..... H01Q 13/10
(52) U.S. Cl. ..... 343/771; 343/770
(58) Field of Search ..... 343/771, 770, 343/767; 333/114, 137

(56) References Cited

U.S. PATENT DOCUMENTS 5,619,216 * 4/1997 Park ..... 343/771
5,650,793 * 7/1997 Park ..... 343/771
5,831,583 * 11/1998 Lagerstedt et al. ..... 343/771

* cited by examiner

*Primary Examiner*—Don Wong
*Assistant Examiner*—Hoang Nguyen
(74) *Attorney, Agent, or Firm*—Kenneth W. Float

(57) ABSTRACT

A communication system and antenna system for use on a satellite. The communication system includes a transmitter and/or a receiver that are respectively coupled to the antenna system. The antenna system includes a plurality of stepped slot waveguides that each have a plurality of slots disposed in a broadwall thereof that form an array of slots. Adjacent slots of each waveguide are offset from a centerline of the respective waveguide and are spaced at half guide wavelength intervals, and selected slots are thus located at a different axial positions relative to other slots in the array. A feed waveguide having in input/output port is provided that couples RF energy between the plurality of stepped slot waveguides and the communication system. The stepped waveguide slot array antenna system provides phase control of the beam pattern produced thereby.

10 Claims, 2 Drawing Sheets

STEPPED WAVEGUIDE SLOT ARRAY WITH PHASE CONTROL AND SATELLITE COMMUNICATION SYSTEM EMPLOYING SAME

BACKGROUND

The present invention relates generally to spacecraft communication systems, and more particularly, to a stepped waveguide slot array antenna system having phase control and satellite communication system employing same.

The assignee of the present invention manufactures and deploys communication satellites. Such communication satellites carry communication systems and antennas that are used to communicate with ground-based communication devices. Heretofore, certain antennas used in such communication systems have employed conventional waveguide slot array designs.

Previous conventional waveguide slot array designs used in-phase radiation contributions from each slot in the array. These designs are well known for their high efficiency but are limited to applications where in-phase contribution produced rather simple beamshapes.

It would therefore be desirable to have a waveguide slot array antenna system for use in a satellite-based communication system that provides phase control. It is therefore an objective of the present invention to provide for a stepped waveguide slot array antenna system having phase control and satellite communication system employing same.

SUMMARY OF THE INVENTION

To accomplish the above and other objectives, the present invention comprises a satellite having a communication system employing an improved stepped waveguide slot array antenna system. The stepped waveguide slot array antenna system provides for improved phase control and results in an improved beam pattern produced by the antenna system.

The stepped waveguide slot array antenna system comprises a plurality of stepped slot waveguides arranged in an array that are fed by a feed waveguide. The stepped slot waveguides have a plurality of slots disposed in their respective radiating surfaces or broadwalls. The slots in each waveguide are alternately offset from a centerline of the waveguide.

More particularly, the slots are spaced at half guide wavelength intervals and adjacent slots are positioned on opposite sides of the centerline of the waveguide. In accordance with the present invention, the slots are located at different axial positions (i.e., orthogonal to the plane of the array). The plurality of stepped slot waveguides provide an impedance matched arrangement of axially stepped waveguide sections that couple RF energy between the feed waveguide and the plurality of radiating slots.

In general, a single feed waveguide couples energy between an input/output port at the back side of the array antenna system and each of the plurality of stepped slot waveguides. The stepped waveguide slot array antenna is part of a satellite communication system comprising a transmitter and/or a receiver that are disposed on a satellite. The transmitter and/or receiver are coupled to the input/output port of the feed waveguide.

The present invention thus provides for a waveguide slot array having high efficiency and structural rigidity that has a configuration capable of allowing electrical phase to be selected by design. This is accomplished by stepping the array (employing stepped waveguides) to provide the desired phase resulting from differential path length in the far field.

The advantage of using the stepped waveguide slot array antenna system is that the radiated phase contribution from each slot may be selected by design of the axially position of each slot in the array. The slots radiate in-phase field contributions but their out-of-plane axial positions allow them to contribute to any desired phase in the far field of the antenna system.

The out-of-phase contributions from each slot in the array antenna system produce a shaped beam. This is not possible using conventional waveguide slot arrays. In the present invention, the phases of each contributing slot is provided by a path length determined by the axial position of the slot. This path length phenomena results in an array antenna that provides very broadband performance.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

By way of introduction, a conventional waveguide slot array uses a set of parallel waveguides with slots on a broadwall of the waveguides to form a two dimensional planar array of slots. The amplitude of excitation of each slot is determined by the offset of that slot from the centerline of the broadwall of the waveguide. The slots are spaced at half guide wavelength intervals and adjacent slots are positioned on opposite sides of the centerline. This arrangement puts all slot radiation contributions in-phase because the current direction reversal in the waveguides each half guide wavelength.

Figure 1:
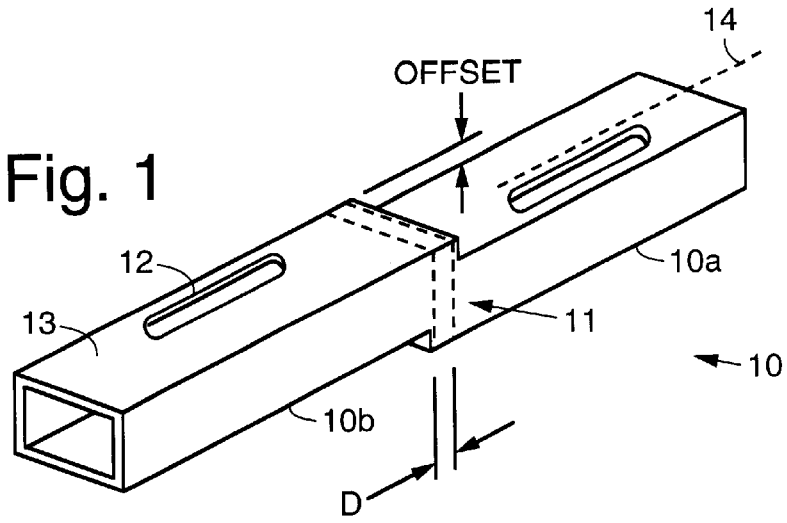
FIG. 1 illustrates a perspective view of an exemplary stepped slot waveguide that may be used in a stepped waveguide slot array antenna in accordance with the principles of the present invention.
Figure 2:
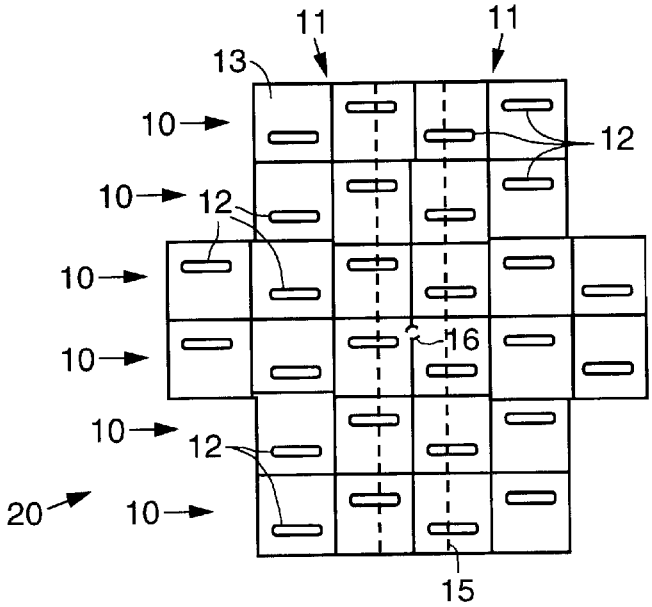
FIG. 2 is a front view of an exemplary stepped waveguide slot array antenna in accordance with the principles of the present invention.
Figure 3:
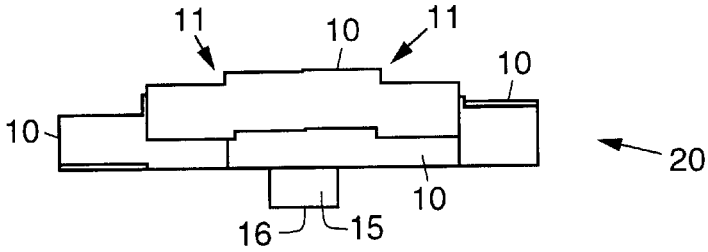
FIG. 3 is a side view of the antenna shown in FIG. 2.
Figure 4:
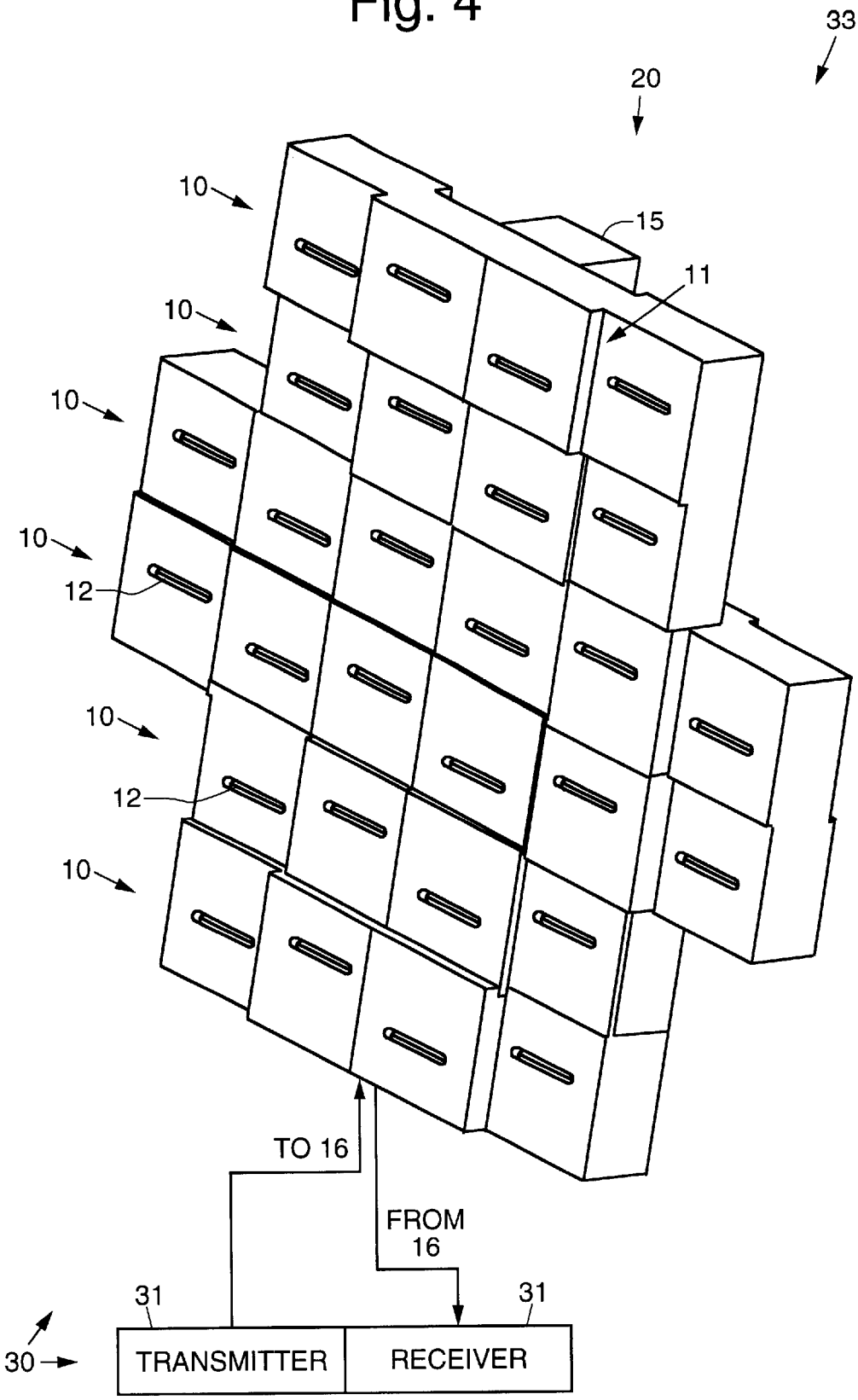
FIG. 4 is a perspective view of the antenna shown in FIG. 2.

Referring now to the drawing figures, FIG. 1 illustrates a perspective view of an exemplary stepped slot waveguide 10 that may be adapted for use in a stepped waveguide slot array antenna system 20 (FIGS. 2–4) in accordance with the principles of the present invention. FIGS. 2 and 3 show front and side views of an exemplary stepped waveguide slot array antenna system 20 in accordance with the principles of the present invention, while FIG. 4 shows a perspective view of the antenna system 20.

The exemplary stepped slot waveguide 10 comprises a thin wall rectangular metallized waveguide structure having a step 11 formed therein such that a first section 10*a* of the waveguide 10 is offset from a second section 10*b* thereof. Respective adjacent ends of the first and second sections 10*a*, 10*b* of the waveguide 10 are separated by a distance "D". Typical offsets are in the range of a quarter of a wavelength for an antenna operating in any frequency band.

Each section 10*a*, 10*b* of the waveguide 10 has a plurality of slots 12 disposed in its broadwall 13 that are offset from a centerline 14 of the waveguide 10. The slots 12 are spaced at half guide wavelength intervals and adjacent slots 12 are positioned on opposite sides of the centerline 14 of the waveguide 10.

The present invention takes advantage of the conventional slot design methodology discussed above to determine the amplitude of excitation, but positions the slots 12 along each waveguide at different axial positions (i.e., orthogonal to the plane of the array). This is illustrated more clearly in FIGS. 2–4. Therefore the total field at each angle of the radiation is the vector addition of contributions that are not in-phase.

This nonuniform phase condition is very useful for beam-shaping and dramatically extends the applications for which the waveguide slot array antenna system 20 is useful. The stepped waveguide 10 shown in FIGS. 2–4 provides this axial positioning capability by presenting an impedance matched arrangement of axially stepped waveguide sections 10*a*, 10*b*.

As is shown in FIGS. 2–4, the exemplary stepped waveguide slot array antenna system 20 comprises six stepped slot waveguides 10. The six stepped slot waveguides 10 are fed by a feed waveguide 15 (illustrated by dashed lines in FIG. 2). The feed waveguide 15 has in input/output port 16 which is located at the rear of the stepped waveguide slot array antenna system 20.

As is shown in FIGS. 3–5, the slots 12 are located at different axial positions relative to the beam pointing direction, which is up in FIG. 3, and to the left and up in FIG. 4. Thus, the slots 12 are displaced (offset) relative to what would be a planar radiating surface in a conventional array.

The stepped waveguide slot array antenna system 20 is part of a satellite communication system 30 comprising a transmitter 31 and/or a receiver 32 that are disposed on a satellite 33 (generally designated in FIG. 5). The transmitter 31 and/or the receiver 32 are coupled to the input/output port 16 of the feed waveguide 15.

The waveguide slot array antenna system 20 has high efficiency and structural rigidity and allows its electrical phase to be selected by design. This is accomplished by stepping the array with predetermined offsets between the radiating surfaces of each waveguide section 10*a*, 10*b*, to provide the desired phase caused by differential path length of the RF energy in the far field.

The radiated phase contribution from each slot 12 of the stepped waveguide slot array antenna system 20 may be selected by selection of the axially position of each slot 12 in the array. The slots 12 radiate in-phase field contributions but their out-of-plane axial positions allows these contributions to be any desired phase that is selected during the design.

The out-of-phase contributions from each slot 12 in the array permits generation of a shaped beam by the array antenna system 20. This is not possible using conventional waveguide slot arrays. In the present invention, the phases of each contributing slot 12 is provided by a path length determined by the axial position of the slot 12. This path length phenomena results in an array antenna 20 that provides very broadband performance.

Thus, a stepped waveguide slot array antenna system having phase control and satellite communication system have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An antenna system for use on a satellite having a communication system, comprising:

a plurality of stepped slot waveguides that each have a plurality of slots disposed in a broadwall thereof that form an array of slots, wherein adjacent slots of each waveguide are offset from a centerline of the respective waveguide and are spaced at half guide wavelength intervals, and wherein selected slots are at a different axial positions relative to other slots in the array; and a feed waveguide having in input/output port that couples RF energy to and from the plurality of stepped slot waveguides.

2. The antenna system recited in claim 1 wherein each of the plurality of stepped slot waveguides comprises an impedance matched arrangement of axially stepped waveguide sections.

3. The antenna system recited in claim 1 wherein communication system comprises a transmitter and/or a receiver that are respectively coupled to the input/output port of the feed waveguide.

4. The antenna system recited in claim 1 whose electrical phase is selected by providing predetermined offsets between radiating surfaces of each stepped slot waveguide to provide the desired phase caused by differential path length of the RF energy in the far field.

5. The antenna system recited in claim 1 which produces a total field at each angle of RF energy that comprises a vector addition of contributions that are not in-phase.

6. A communication system for use on a satellite, comprising:

a transmitter and/or a receiver; and an antenna system comprising a plurality of stepped slot waveguides that each have a plurality of slots disposed in a broadwall thereof that form an array of slots, wherein adjacent slots of each waveguide are offset from a centerline of the respective waveguide and are spaced at half guide wavelength intervals, and wherein selected slots are at a different axial positions relative to other slots in the array, and a feed waveguide having in input/output port that couples RF energy to and from the plurality of stepped slot waveguides.

7. The communication system recited in claim 6 wherein each of the plurality of stepped slot waveguides comprises an impedance matched arrangement of axially stepped waveguide sections.

8. The communication system recited in claim 6 wherein the antenna system produces a total field at each angle of RF energy that comprises a vector addition of contributions that are not in-phase.

9. The communication system recited in claim 8 wherein the electrical phase of the antenna system is selected by providing predetermined offsets between radiating surfaces of each stepped slot waveguide to provide the desired phase caused by differential path length of the RF energy in the far field.

10. The communication system recited in claim 6 wherein the transmitter and/or the receiver are respectively coupled to the input/output port of the feed waveguide.

* * * * *